United States Patent [19]

Fukunaga et al.

[11] Patent Number: 4,505,099

[45] Date of Patent: Mar. 19, 1985

[54] YARN CUTTING DEVICE IN TWISTER

[75] Inventors: Mitsuo Fukunaga, Kyoto; Isao Nagao, Shiga, both of Japan

[73] Assignee: Murata Kikai Kabushiki Kaisha, Kyoto, Japan

[21] Appl. No.: 535,740

[22] Filed: Sep. 26, 1983

[30] Foreign Application Priority Data

Sep. 28, 1982 [JP] Japan ..... 57-147488[U]

[51] Int. Cl.[3] ..... D01H 13/14; D01H 7/86

[52] U.S. Cl. ..... 57/86; 57/58.3

[58] Field of Search ..... 57/58.3, 58.36, 58.38, 57/61, 58.49, 78, 58.52, 80, 81, 82, 86, 87

[56] References Cited

U.S. PATENT DOCUMENTS 2,902,817 9/1959 Schrenk et al. ..... 57/58.36
2,958,177 11/1960 Seidl ..... 57/86 X
3,995,418 12/1976 Neyraud ..... 57/88
4,117,654 10/1978 Petrov et al. ..... 57/80 X

FOREIGN PATENT DOCUMENTS 248363 4/1961 Australia ..... 57/58.36

*Primary Examiner*—Donald Watkins
*Attorney, Agent, or Firm*—Spensley Horn Jubas & Lubitz

[57] ABSTRACT

A device for cutting fed yarns at a suitable position in quick response to the breakage of the yarn when a plurality of yarns are arranged and twisted together in a twisting frame. A first cutter which is operated by a detecting device and cuts the yarn on the yarn feeding side and a second cutter which is operated by the detecting device and cuts the yarn on the yarn taking out side of the twisting frame.

7 Claims, 2 Drawing Figures

YARN CUTTING DEVICE IN TWISTER

BACKGROUND OF THE INVENTION

The present invention relates to a yarn cutting device in a twister.

When a plurality of yarns are twisted together in a twisting frame, even if one of them is broken, an abnormally twisted yarn is taken up. In order to avoid this undesirable situation, it has been proposed to cut the abnormally twisted yarn on the winding side simultaneously with the yarn breakage as described above. This method, however, causes such as inconvenience that an end portion of yarn produced by the yarn breakage or the cutting twines itself round a spindle or the like of the twisting frame.

SUMMARY OF THE INVENTION

The present invention relates to a yarn cutting device in a twister, and more particularly, relates to a device for cutting fed yarns at a suitable position in quick response to the breakage of the yarn when a plurality of yarns are arranged and twisted together in a twisting frame.

An object of the present invention is to provide a cutting device in which fed yarns are cut simultaneously with the occurrence of a yarn breakage and cut yarn ends do not twine itself on the twisting frame.

The device of the present invention comprises a yarn breakage detecting device for detecting a change in the tension on the twisted yarn, a first cutter which is operated by the detecting device and cuts the second yarn component on the yarn feeding side of the twisting frame, and a second cutter which is operated by the detecting device and cuts the first yarn component on the yarn taking-up side of the twisting frame.

In accordance with the present invention, the fed yarn is cut simultaneously with the occurrence of a yarn breakage. As a result, such a situation does not arise that a defective yarn is wound on the package in some length. Further, when a yarn is broken, it will not twine itself on the spindle or other parts, thus dispending with a cumbersome operation.

DETAILED DESCRIPTION OF THE INVENTION

One illustrative example of the invention is hereinafter described with reference to the drawings.

Figure 1:
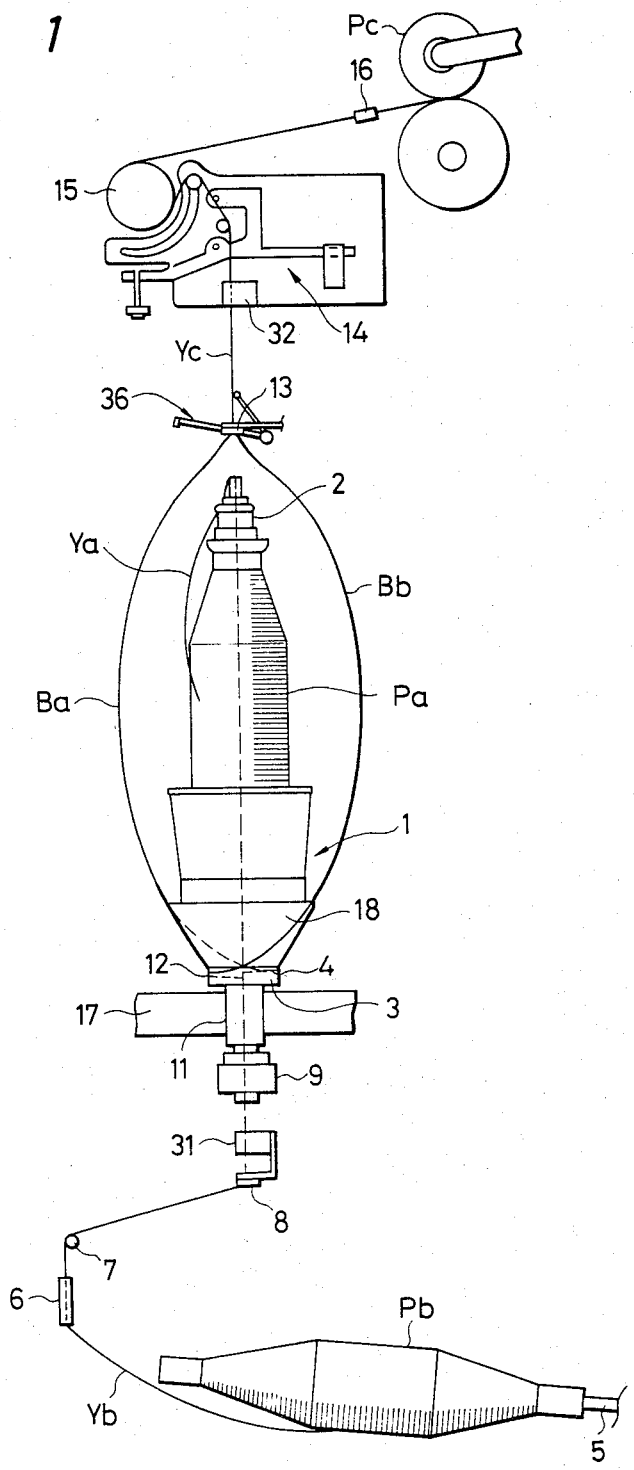
FIG. 1 is a schematic representation of a two for one twister.

FIG. 1 is a schematic representation of the whole construction of a two for one twisting machine, in which a package of a first yarn component (Pa) is installed in a two for one twister 1. A first yarn component (Ya) taken out from the package (Pa) is passed from the upper end of a tenser 2 to the center of a yarn storage table 3 through a yarn passing hole (not shown). Then, the yarn passes through another yarn passing hole made radially in the storage table. Thereafter, it is drawn out through a yarn guide hole 4.

Supported below the two for one twister 1 is a package of a second yarn component (Pb) mounted on a peg 5. A second yarn component (Yb) taken out from the package (Pb) is introduced into a supporting pipe 9 supporting the frame 1 via a guide roller 7 and a guide ring 8. The yarn is then brought out through a yarn guide hole 12 after being passed through a spindle 11 and a yarn passing hole formed in the storage disk 3.

The first yarn component (Ya) and the second yarn component (Yb) brought out as described above are pulled upward while ballooning out as indicated by Ba and Bb, respectively. Then, the yarns are arranged together at a balloon guide ring 13 and then twisted together to produce a twisted yarn (Yc), which then passes by a yarn breakage detecting device 14 and a feed roller 15 and reaches a traverser 16. There, a reciprocating motion is given to the yarn, and it is wound on a take-up package (Pc).

The operation of the twister 1 is well known in the prior art. That is, the spindle 11 engages with a running belt 17 and hence is caused to turn. This rotates the yarn storage table 3 together with a turntable 18. At the same time, the first yarn component (Ya) is drawn out to effect twisting operation while the package (Pa) is held stationary. At the same time, the second yarn component (Yb) is drawn out in the present twister.

Figure 2:
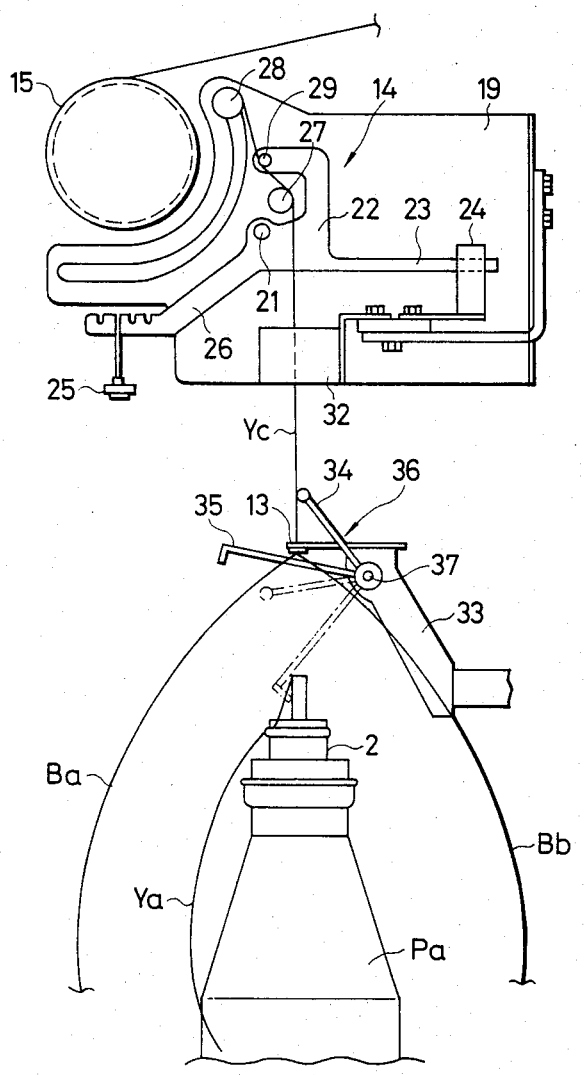
FIG. 2 shows the peripheral portion of the yarn breakage detecting device shown in FIG. 1.

The details of the yarn breakage detecting device 14 are shown in FIG. 2, in which the device 14 comprises a rocking plate 22 and a sensor 24, which acts to detect the leg 23 extending from the plate 22. The rocking plate 22 is rotatably mounted to a shaft 21 in a bracket 19 that is fixed to a frame (not shown). The plate 22 includes an arm 26, from which a balance weight 25 depends, and a pin 29 which is in contact with the twisted yarn (Yc) between guide rollers 27, 28 secured to the bracket 19. The weight of the balance weight 25 urges the arm 22 to rotate in the counterclockwise direction as viewed in the drawing, thus pressing the pin 29 against the yarn (Yc).

When one or both of the first yarn component (Ya) and the second yarn component (Yb) are broken for one cause or another during twisting operation, the tension on the twisted yarn (Yc) between the guide rollers 27 and 28 decreases abruptly. This rotates the rocking plate 22 about the shaft 21, moving the leg 23 away from the sensor 24. Thus, the sensor 24 having a photoelectric structure detects the occurrence of the yarn breakage and operates cutters 31 and 32.

The first cutter 31 is disposed between the guide ring 8 and the supporting pipe 9 which supports the twister 1, and the cutter surrounds the yarn path of a running second yarn component (Yb). As soon as a yarn breakage is detected by the detecting device 14, the first cutter mechanically and momentarily cuts the second yarn component (Yb) with blades (not shown). It is obvious that if the yarn breakage occurs below the first cutter 31, that is, the second yarn component (Yb) is broken, the cutter 31 cuts the air rather than a yarn. The second cutter 32 is disposed between the balloon guide ring 13 and the detecting device 14 and is fixed to the bracket 18. Although the second cutter is similar in structure and operation to the first cutter 31, a timer, a delay circuit, or the like functions to operate the second cutter later than the first cutter 31 by 0.5 to 3.0 seconds. At this time, the first yarn component (Ya) or the second yarn component (Yb) in the second cutter 32 is cut.

A bracket 33 supports the balloon guide ring 13, and a presser foot 36 is rotatably secured to the bracket by a shaft 37. The presser foot 36 has a feeler 34 and a drop wire 35. The tip of the feeler 34 is caused to lightly contact the twisted yarn (Yc), so that the feeler is prevented from rotating. When the second cutter 32 cuts a yarn, any yarn ceases to exist at the contact position, whereby the feeler is unlocked. The presser foot 36 then rotates in the counterclockwise direction as viewed in the drawing by its own weight until the drop wire 35 abuts against the top of the tenser 2 and stops as indicated by the phantome lines in FIG. 2. At this time, the tip of the drop wire presses the first yarn component (Ya) so that the yarn (Ya) is no longer taken out from the package (Pa).

When the first yarn component (Ya) or the second yarn component (Yb) is broken in the aforementioned twister during twisting operation, the yarn breakage detecting device 14 detects it simultaneously with its occurrence and operates the first cutter 31 and the second cutter 32 to cut the first yarn component (Ya) and the second yarn component (Yb).

In case where the first yarn component (Ya) is broken, the first cutter 31 is operated to cut the running second yarn component (Yb). Then, after a lapse of 0.5 to 3.0 seconds, the second cutter 32 is operated. The piece of the yarn which is produced on the first yarn component (Ya) winding side by the yarn breakage passes across the second cutter 32 during a period beginning with the occurrence of the yarn breakage and ending with the actuation of the second cutter 32. At this time, the piece of the yarn which is produced on the second yarn component (Yb) winding side by the cutting using the first cutter 31 is pulled upward close to the second cutter 32.

Consequently, the second cutter 32 cuts only the second yarn component (Yb). The piece of the yarn produced by the cutting is relatively short, and falls near the twister or is blown off. If the end of the second yarn component (Yb) on the winding side has already passed across the second cutter 32 when the cutter 32 is set into motion, then it cuts the air and no piece of yarn is cut off.

In case where the second yarn component (Yb) is broken, the first cutter 31 cuts either the air or the second yarn component (Yb), depending on whether the breakage takes place below or above the cutter 31. The piece of the yarn cut off by the breakage and the cutting falls in the same manner as the foregoing. When the second cutter 32 begins to operate, the end of the second yarn component (Yb) on the winding side has already passed across the cutter 32, and therefore the cutter 32 cuts only the first yarn component (Ya).

When any yarn ceases to exist between the second cutter 32 and the balloon guide ring 13 by the cutting operation of the second cutter, the presser foot 36 is rotated to prevent further supply of the first yarn component (Ya) as described above. Up to this time, the second yarn component (Yb) ceases to exist in the two for one twister 1 as described previously, whether the first yarn component (Ya) or the second yarn component (Yb) is broken. However, a length of the second yarn component (Yb) on the supply side is left, and this whirled by the rotation of the yarn storage table 3.

If the second yarn component (Yb) is left in the two for one twister 1, the piece of the first yarn component (Ya) on the supply side may twine itself round the left under yarn thus to hinder the piece of the middle yarn from whirling as described above. In the present two for one twister, however, the piece of the yarn is whirled unimpeded as stated above. Further, the stoppage of the supply of the yarn causes an increase in the tension with the result that the piece of the first yarn component (Ya) on the supply side is cut by a larger length near the yarn guide hole 4. Finally, both pieces of the yarns are cut and hence no yarn twines itself on the spindle 11 and other elements.

It is also possible to operate the first cutter 31 and the second cutter 32 simultaneously. Further, this simultaneous operation may be started slightly later than the detection of a yarn breakage. In this case, a piece of a yarn, which is cut off and falls, tends to have a larger length and so this is uneconomical. In addition, it is possible that the piece of yarn twines itself about other mechanical parts. Consequently, it is preferred that the delay be appropriately adjusted in association with the velocity of the yarns or other factors. Furthermore, the presser foot 36 may be omitted without introducing difficulties, depending on the kind of yarn or other factors. Additionally, the cutting device according to the invnetion is not limited to two for one twisters and may also be applied with equal utility to single twister and the like.

What is claimed is:

1. A yarn cutting device in a two for one twister, the twister being adapted to draw out a first yarn component from a package of a first yarn component installed in a twisting frame while drawing out a second yarn component from a package of a second yarn component disposed below the twisting frame via the hollow spindle of the twisting frame and through a guide hole made in a yarn storage table for arranging and twisting together the drawn out first and second yarn components and for winding these yarns, the yarn cutting device comprising:

a yarn breakage detecting device for detecting a change in the tension on said twisted yarn, a first cutter which is operated by the detecting device and cuts the second yarn component at a position on the yarn feeding side with regard to the twisting frame, and a second cutter which is operated by the detecting device and cuts the first yarn component at a position on the yarn winding side with regard to the twisting frame.

2. A yarn cutting device as claimed in claim 1, wherein said yarn breakage detecting device comprises a rocking plate which is rotatably mounted to a shaft in a bracket, a sensor which acts to detect a leg extending from the rocking plate, a pin mounted on the rocking plate and being able to fall in contact with the twisted yarn and a means for urging the rocking plate so that the pin is pressed against the twisted yarn.

3. A yarn cutting device as claimed in claim 2, wherein said means for urging the rocking plate comprises a balance weight and an arm which is provided on the rocking plate and from which the balance weight depends.

4. A yarn cutting device as claimed in claim 2, wherein said sensor has a photoelectric structure.

5. A yarn cutting device as claimed in any one of claims 1 to 4, wherein said first cutter is disposed between a supporting pipe which supports the twisting frame and a guide ring for the second yarn component taken out from the package of the second yarn component, and said second cutter is disposed between the detecting device and a balloon guide ring at which the first yarn component and the second yarn component brought out from the package of the first yarn component and the package for the second yarn component and pulled out while ballooning respectively are arranged together.

6. A yarn cutting device as claimed in claim 5, wherein said first and second cutters are operated electrically and the second cutter is set to be operated later than the first cutter by 0.5 to 3.0 seconds.

7. A yarn cutting device as claimed in claim 5, wherein a presser foot having a feeler and a drop wire is further rotatably secured to the bracket supporting the balloon guide ring by a shaft, said tip of the feeler being caused to lightly contact the twisted yarn so as the feeler to be prevented from rotating and the presser foot is so constructed that it rotates by own weight until the drop wire abuts against the top of the tenser to press the first yarn component when the second cutter cuts the yarns.

* * * * *